US011056093B2

(12) United States Patent
Scanlan

(10) Patent No.: US 11,056,093 B2
(45) Date of Patent: Jul. 6, 2021

(54) AUTOMATIC NOISE CANCELLATION USING MULTIPLE MICROPHONES

(71) Applicant: Avnera Corporation, Hillsboro, OR (US)

(72) Inventor: James Scanlan, San Francisco, CA (US)

(73) Assignee: AVNERA CORPORATION, Hillsboro, OR (US)

( * ) Notice: Subject to any disclaimer, the term of this patent is extended or adjusted under 35 U.S.C. 154(b) by 161 days.

(21) Appl. No.: 16/446,064

(22) Filed: Jun. 19, 2019

(65) Prior Publication Data

US 2019/0304430 A1 Oct. 3, 2019

Related U.S. Application Data

(63) Continuation of application No. 15/792,378, filed on Oct. 24, 2017, now Pat. No. 10,354,639.
(Continued)

(51) Int. Cl.
*H04R 1/10* (2006.01)
*G10K 11/178* (2006.01)
(Continued)

(52) U.S. Cl.
CPC ..... *G10K 11/178* (2013.01); *G10K 11/17815* (2018.01); *G10K 11/17881* (2018.01);
(Continued)

(58) Field of Classification Search
CPC .. H04R 1/1008; H04R 1/1041; H04R 1/1083; H04R 1/406; H04R 3/005; H04R 29/005; H04R 2410/05; H04R 2460/01; G10K 2210/3046; G10K 2210/503; G10K 11/1785; G10K 11/1786; G10K 11/178;
(Continued)

(56) References Cited

U.S. PATENT DOCUMENTS 8,818,000 B2 8/2014 Andrea
9,401,158 B1 7/2016 Yen et al.
(Continued)

FOREIGN PATENT DOCUMENTS

WO 2014055312 A1 4/2014

OTHER PUBLICATIONS

International Search Report and Written Opinion issued in International Application No. PCT/US2017/058129, dated Feb. 5, 2018 (16 pgs.).

*Primary Examiner* — Kile O Blair
(74) *Attorney, Agent, or Firm* — Lando & Anastasi. LLP

(57) ABSTRACT

The disclosure includes a headset comprising one or more earphones including one or more sensing components. The headset also includes one or more voice microphones to record a voice signal for voice transmission. The headset also includes a signal processor coupled to the earphones and the voice microphones. The signal processor is configured to employ the sensing components to determine a wearing position of the headset. The signal processor then selects a signal model for noise cancellation. The signal model is selected from a plurality of signal models based on the determined wearing position. The signal processor also applies the selected signal model to mitigate noise from the voice signal prior to voice transmission.

20 Claims, 4 Drawing Sheets

Related U.S. Application Data

(60) Provisional application No. 62/412,214, filed on Oct. 24, 2016.

(51) Int. Cl.
*H04R 1/40* (2006.01)
*H04R 3/00* (2006.01)
*H04R 29/00* (2006.01)

(52) U.S. Cl.
CPC ..... *H04R 1/1008* (2013.01); *H04R 1/1041* (2013.01); *H04R 1/1083* (2013.01); *H04R 1/406* (2013.01); *H04R 3/005* (2013.01); *H04R 29/005* (2013.01); *G10K 11/17833* (2018.01); *G10K 2210/1081* (2013.01); *G10K 2210/111* (2013.01); *G10K 2210/3026* (2013.01); *G10K 2210/3027* (2013.01); *G10K 2210/3046* (2013.01); *G10K 2210/503* (2013.01); *H04R 2410/05* (2013.01); *H04R 2460/01* (2013.01)

(58) Field of Classification Search
CPC ..... G10K 11/17815; G10K 11/17881; G10K 11/17833; G10K 2210/1081; G10K 2210/111; G10K 2210/3026; G10K 2210/3027
See application file for complete search history.

(56) References Cited

U.S. PATENT DOCUMENTS

| | | | | |
|---|---|---|---|---|
| 10,178,485 | B2 * | 1/2019 | Lee | H04R 1/1041 |
| 2010/0246846 | A1 | 9/2010 | Burge et al. | |
| 2011/0222701 | A1 | 9/2011 | Donaldson et al. | |
| 2013/0182867 | A1 | 7/2013 | Knowles | |
| 2014/0146976 | A1 | 5/2014 | Rundle | |
| 2014/0294193 | A1 | 10/2014 | Tikander et al. | |
| 2014/0307890 | A1 | 10/2014 | Zhou et al. | |
| 2015/0201271 | A1 | 7/2015 | Diethorn et al. | |
| 2016/0050509 | A1 | 2/2016 | Madhu et al. | |
| 2016/0241974 | A1 | 8/2016 | Jensen et al. | |
| 2017/0195802 | A1 | 7/2017 | Eichfeld et al. | |

* cited by examiner

AUTOMATIC NOISE CANCELLATION USING MULTIPLE MICROPHONES

CROSS-REFERENCES TO RELATED APPLICATIONS

The present application is a continuation of co-pending U.S. patent application Ser. No. 15/792,378, filed Oct. 24, 2017, now U.S. Pat. No. 10,354,639, entitled "AUTOMATIC NOISE CANCELLATION USING MULTIPLE MICROPHONES," which claims benefit from U.S. Provisional Patent Application Ser. No. 62/412,214, filed Oct. 24, 2016, and entitled "AUTOMATIC NOISE CANCELLATION USING MULTIPLE MICROPHONES," which is incorporated herein by reference as if reproduced its entirety.

BACKGROUND

Active Noise Cancellation (ANC) headsets are generally architected to employ microphones in each ear. The signals captured by the microphones are employed in conjunction with a compensation algorithm to reduce ambient noise for the wearer of the headset. ANC headsets may also be employed when making telephone calls. An ANC headset used for phone calls may reduce local noise in ear, but the ambient noise in the environment is transmitted unmodified to the remote receiver. This situation may result in reduced phone call quality experienced by the user of the remote receiver.

BRIEF DESCRIPTION OF THE DRAWINGS

Aspects, features and advantages of embodiments of the present disclosure will become apparent from the following description of embodiments in reference to the appended drawings in which.

DETAILED DESCRIPTION

Uplink noise cancellation may be employed to mitigate transmitted ambient noise. However, uplink noise cancellation processes operating on headsets face certain challenges. For example, a user employing a telephone can be assumed to be holding a transmission microphone near their mouth and a speaker near their ear. Noise cancellation algorithms that employ spatial filtering processes, such as beamforming, may then be employed to filter noise from a signal recorded near the user's mouth. In contrast, a headset may be worn in multiple configurations. As such, a headset signal processor may be unable to determine the relative direction of the user's mouth to the voice microphone. Accordingly, the headset signal processor may be unable to determine which spatial noise compensation algorithms to employ to remove noise. It should be noted that selecting the wrong compensation algorithm may even attenuate user speech and amplify the noise signal.

Disclosed herein is a headset configured to determine a wearing position and select a signal model for uplink noise cancellation during speech transmission based on the wearing position. For example, a user may wear the headset with a left earphone in the left ear and a right earphone in the right ear. In such a case, the headset may employ various voice activity detection (VAD) techniques. For example, a feed forward (FF) microphone at the left earphone and a FF microphone at the right earphone can be employed as a broadside beamformer to attenuate noise from the left side of the user and the right side of the user. Further, a lapel microphone can be employed as a vertical endfire beamformer to further separate the user's voice from the ambient noise. In addition, signals recorded by FF microphones outside of the users ear can be compared to feedback (FB) microphones positioned inside the users ear to isolate noise from audio signals. In contrast, when a user employs an earphone in a single ear, the broadside beamformer may be turned off. Further, the endfire beamformer may be pointed toward the users mouth depending on the expected position of the lapel microphone when one earphone is disengaged. Also, the FF and FB microphones in the disengaged earphone may be deemphasized and/or ignored for ANC purposes. Finally, ANC may be disengaged when both earphones are disengaged. The wearing position may be determined by employing optional sensing components and/or by comparing FF and FB signals for each ear.

Figure 1:
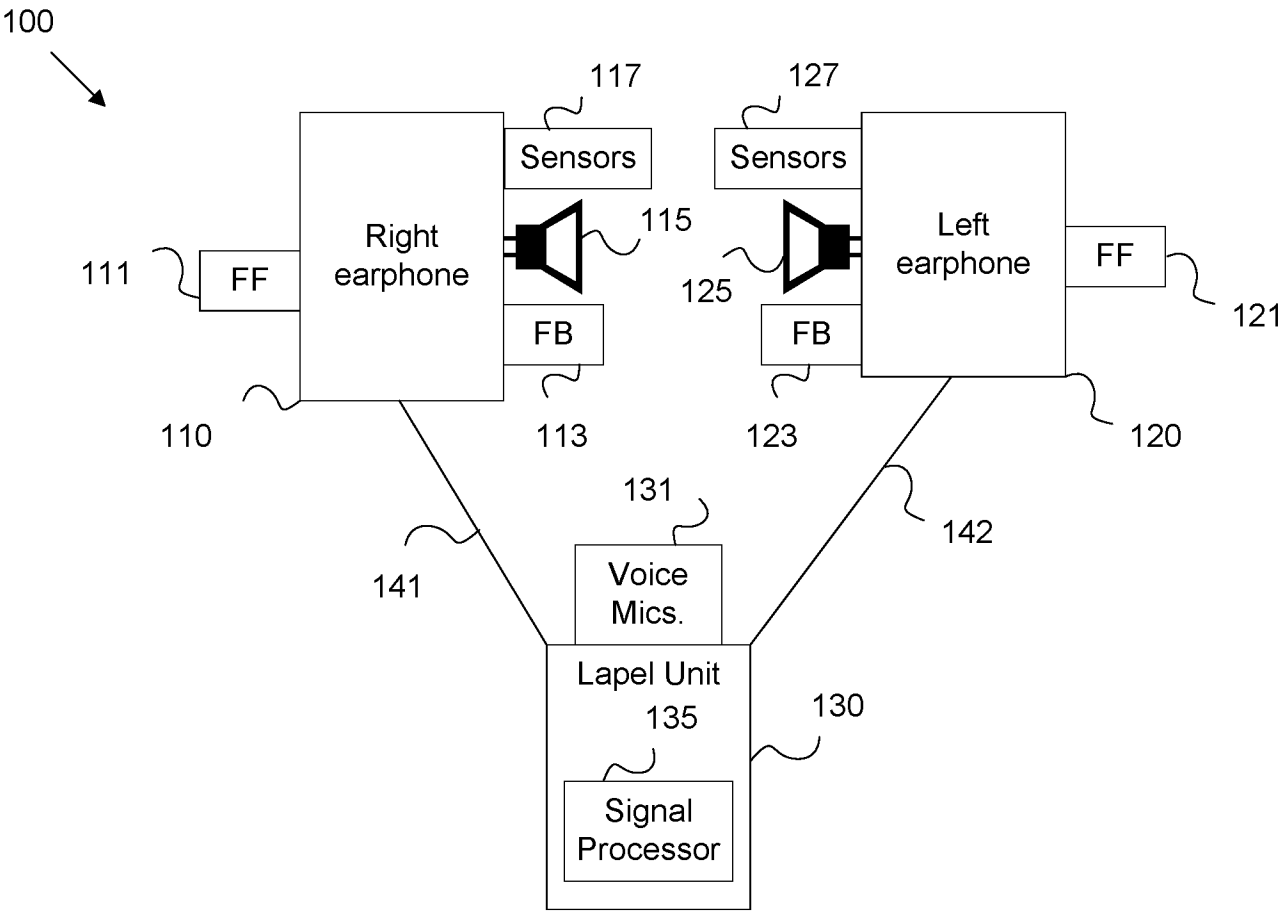
FIG. 1 is a schematic diagram of an example headset for noise cancellation during uplink transmission.

FIG. 1 is a schematic diagram of an example headset 100 for noise cancellation during uplink transmission. The headset 100 includes a right earphone 110, a left earphone 120, and a lapel unit 130. However, it should be noted that certain mechanisms disclosed herein may be employed in an example headset including a single earphone and/or an example without a lapel unit 130. The headset 100 may be configured to perform local ANC, for example when the lapel unit 130 is coupled to a device that plays music files. The headset 100 may also perform unlink noise cancellation, for example when the lapel unit 130 is coupled to a device capable of making phone calls (e.g. a smart phone).

The right earphone 110 is a device capable of playing audio data, such as music and/or voice from a remote caller. The right earphone 110 may be crafted as a headphone that can be positioned adjacent to a user's ear canal (e.g. on ear). The right earphone 110 may also be crafted as a earbud, in which case at least some portion of the right earphone 110 may be positioned inside a user's ear canal (e.g. in-ear). The right earphone 110 includes at least a speaker 115 and a FF microphone 111. The right earphone 110 may also include a FB microphone 113 and/or sensors 117. The speaker 115 is any transducer capable of converting voice signals, audio signals, and/or ANC signals into soundwaves for communication toward a user's ear canal.

An ANC signal is audio waveform generated to destructively interfere with waveforms carrying ambient noise, and hence canceling the noise from the user's perspective. The ANC signal may be generated based on data recorded by the FF microphone 111 and/or the FB microphone 113. The FB microphone 113 and the speaker 115 are positioned together on a proximate wall of the right earphone 110. Depending on the example, the FB microphone 113 and speaker 115 are positioned inside a user's ear canal when engaged (e.g. for an earbud) or positioned adjacent to the user's ear canal in an acoustically sealed chamber when engaged (e.g. for an earphone). The FB microphone 113 is configured to record soundwaves entering the user's ear canal. Hence, the FB microphone 113 detects ambient noise perceived by the user, audio signals, remote voice signals, the ANC signal, and/or the user's voice which may be referred to as a sideband signal. As the FB microphone 113 detects both the ambient noise perceived by the user and any portion of the ANC signal that is not destroyed due to destructive interference, the FB microphone 113 signal may contain feedback information. The FB microphone 113 signal can be used to adjust the ANC signal in order to adapt to changing conditions and to better cancel the ambient noise.

The FF microphone 111 is positioned on a distal wall of the earphone and maintained outside of the user's ear canal and/or the acoustically sealed chamber, depending on the example. The FF microphone 111 is acoustically isolated from the ANC signal and generally isolated from remote voice signals and audio signals when the right ear phone is engaged. The FF microphone 111 records ambient noise as user voice/sideband. Accordingly, the FF microphone 111 signal can be used to generate an ANC signal. The FF microphone 111 signal is better able to adapt to high frequency noises than the FB microphone 113 signal. However, the FF microphone 111 cannot detect the results of the ANC signal, and hence cannot adapt to non-ideal situations, such as a poor acoustic seal between the right earphone 110 and the ear. As such, the FF microphone 111 and the FB microphone 113 can be used in conjunction to create an effective ANC signal.

The right earphone 110 may also sensing components to support off ear detection (OED). For example, signal processing for ANC assumes that the right earphone 110 (and left earphone 230) are properly engaged. Some ANC processes may not work as expected when the user removes one or more earphones. Hence, the headset 100 employs sensing components to determine that an earphone is not properly engaged. In some examples, the FB microphone 113 and the FF microphone 111 are employed as sensing components. In such a case, the FB microphone 113 signal and the FF microphone 111 signal are different when the right earphone 110 is engaged due to the acoustic isolation between the earphones. When the FB microphone 113 signal and the FF microphone 111 signal are similar, the headset 100 can determine that the corresponding earphone 110 is not engaged. In other examples, sensors 117 can be employed as sensing components to support OED. For example, the sensors 117 may include an optical sensor that indicates low light levels when the right earphone 110 is engaged and higher light levels when the right earphone 110 is not engaged. In other examples, the sensors 117 may employ pressure and/or electrical/magnetic currents and/or fields to determine when the right earphone 110 is engaged or disengaged. In other words, the sensors 117 may include capacitive sensors, infrared sensors, visual light optical sensors, etc.

The left earphone 120 is substantially similar to the right earphone 110, but configured to engage with a user's left ear. Specifically, the left earphone 120 may include sensors 127, speaker 125, a FB microphone 123, and a FF microphone 121, which may be substantially similar to the sensors 117, the speaker 115, the FB microphone 113, and the FF microphone 121. The left earphone 120 may also operate in substantially the same manner as the right earphone 110 as discussed above.

The left earphone 120 and the right earphone 110 may be coupled to a lapel unit 130 via a left cable 142 and a right cable 141, respectively. The left cable 142 and the right cable 141 are any cables capable of conducting audio signals, remote voice signals, and/or ANC signals from the lapel unit to the left earphone 120 and the right earphone 110, respectively.

The lapel unit 130 is an optional component is some examples. The lapel unit 130 includes one or more voice microphones 131 and a signal processor 135. The voice microphones 131 may be any microphone configured to record a user's voice signal for uplink voice transmission, for example during a phone call. In some examples, multiple microphones may be employed to support beamforming techniques. Beamforming is a spatial signal processing technique that employs multiple receivers to record the same wave from multiple physical locations. A weighted average of the recording may then be used as the recorded signal. By applying different weights to different microphones, the voice microphones 131 can be virtually pointed in a particular direction for increased sound quality and/or to filter out ambient noise. It should be noted that the voice microphones 131 may also be positioned in other locations in some examples. For example, the voice microphones 131 may hang from cables 141 or 142 below the right earphone 110 or the left earphone 120, respectively. The beamforming techniques disclosed herein are equally applicable to such a scenario with minor geometric modifications.

The signal processor 135 is coupled to the left earphone 120 and right earphone 110, via the cables 142 and 141, and to the voice microphones 131. The signal processor 135 is any processor capable of generating an ANC signal, performing digital and/or analog signal processing functions, and/or controlling the operation of the headset 100. The signal processor 135 may include and/or be connected to memory, and hence may be programmed for particular functionality. The signal processor 135 may also be configured to convert analog signals into a digital domain for processing and/or convert digital signals back to an analog domain for playback by the speakers 115 and 125. The signal processor 135 may be implemented as a general purpose processor, and application specific integrated circuit (ASIC), a digital signal processor (DSP), a field programmable gate array (FPGA), or combinations thereof.

The signal processor 135 may be configured to perform OED and VAD based on signals recorded by sensors 117 and 127, FB microphones 113 and 123, FF microphones 111 and 121 and/or voice microphones 131. Specifically, the signal processor 135 employs the various sensing components to determine a wearing position of the headset 100. In other words, the signal processor 135 can determine whether the right earphone 110 and the left earphone 120 are engaged or disengaged. Once the wearing position is determined, the signal processor 135 can select an appropriate signal model for VAD and corresponding noise cancellation. The signal model may be selected from a plurality of signal models based on the determined wearing position. The signal processor 135 then applies the selected signal model perform VAD and mitigate noise from the voice signal prior to uplink voice transmission.

For example, the signal processor 135 may perform OED by employing the FF microphones 111 and 121 and the FB microphones 113 and 123 as sensing components. The wearing position of the headset 100 can then be determined based on a difference between the FF microphone 111 and 121 signals and the FB microphone 113 and 123 signals, respectively. It should be noted that difference includes subtraction as well as any other signal processing technique that compares signals, such as comparison of spectra ratios via transfer function, etc. In other words, when the FF microphone 111 signal is substantially similar to the FB microphone 113 signal, the right earphone 110 is disengaged. When the FF microphone 111 signal is different from the FB microphone 113 signal (e.g. contains different waves at a specified frequency band), the right earphone 110 is engaged. The engagement or disengagement of the left earphone 120 can be determined in substantially the same manner by employing the FF microphone 121 and the FB microphone 123. In another example, the sensing components may include an optical sensor 117 and 127. In such a case, the wearing position of the headset is determined based on a light level detected by the optical sensor 117 and 127.

Once the wearing positioned has been determined by the OED process performed by the signal processor 135, the signal processor can select a proper signal model for further processing. In some examples, the signal models include a left earphone engagement model, a right earphone engagement model, a dual earphone engagement model, and a null earphone engagement model. The left earphone engagement model is employed when the left earphone 120 is engaged and the right earphone 110 is not. The right earphone engagement model is employed when the right earphone 110 is engaged and the left earphone 120 is not. The dual earphone engagement model is employed when both earphones 110 and 120 are engaged. The null earphone engagement model is employed when both earphones 110 and 120 are disengaged. The models are each discussed in more detail with respect to the Figs. below.

Figure 2:
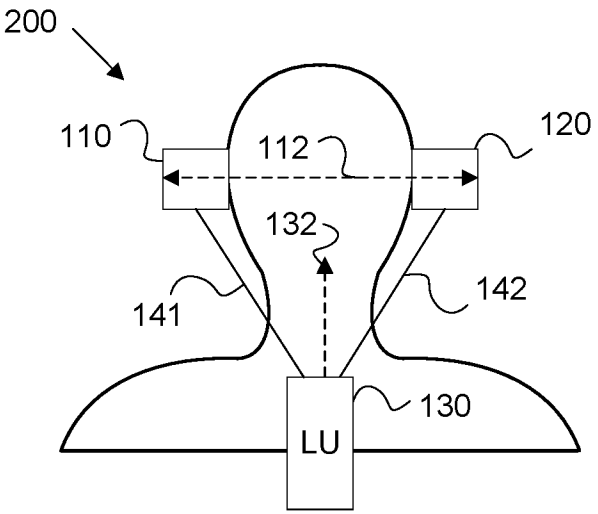
FIG. 2 is a schematic diagram of example dual earphone engagement model for performing noise cancellation.

FIG. 2 is a schematic diagram of example dual earphone engagement model 200 for performing noise cancellation. The dual earphone engagement model 200 is employed when the OED process determines that both earphones 110 and 120 are properly engaged. This scenario results in the physical configuration shown. It should be noted that the components shown may not be drawn to scale. However, it should also be noted that this scenario results in a configuration where the lapel unit 130 hangs from the earphones 110 and 120, via cables 141 and 142, with the voice microphones 131 generally pointed toward the users mouth. Further, the earphones 110 and 120 are approximately equidistant from the user's mouth, which lies on a plane perpendicular to a plane between the earphones 110 and 120. In this configuration, multiple processes may be employed to detect and record the user's voice, and hence remove ambient noise from such a recording.

Specifically, VAD can be derived from the earphones 110 and 120 by reviewing for cross-correlation between audio signals received on the FF microphones 111 and 121 as well as using beamforming techniques. For example, signals correlated between the FF microphones 111 and 121 are likely to originate in the general plane equidistant from both ears, and hence are likely to include speech of the headset user, or at least in. These waveforms originating from this location may be referred to as binaural VAD. In other words, the dual earphone engagement model 200 may be applied by correlating a left earphone 120 FF microphone 121 signal and a right earphone 110 FF microphone 111 signal for isolating a noise signal from the voice signal when the left earphone 120 and the right earphone 110 are engaged.

As another example, a broadside beamformer 112 may be created for local speech transmit enhancement, since both ears are generally equidistant from the mouth. In other words, the dual earphone engagement model 200 may be applied by employing a left earphone 120 FF microphone 121 and a right earphone 110 FF microphone 111 as a broadside beamformer 112 for isolating a noise signal from the voice signal when the left earphone 120 and the right earphone 110 are engaged. Specifically, a broadside beamformer 112 is any beamformer where the measured wave (e.g. speech) is incident to an array of measuring elements (e.g. the FF microphones 111 and 121) at broadside, and hence an approximately one hundred eighty degree phase difference is measured between the measuring elements. By properly weighting the signal from the FF microphones 111 and 121, the broadside beamformer 112 can isolate the voice signal from ambient noise not occurring between the users ears (e.g. noise from the users left or the users right). Once the noise signal has been isolated, the ambient noise can be filtered out prior to uplink transmission to a remote user over a phone call.

In summary, when the earphones 110 and 120 are well-fitted, the signal of the in-ear FB microphones 113 and 123 and the FF microphones 111 and 121 on the outside of the earphones 110 and 120 can be deconstructed into two signals, local speech of the user and ambient noise. Ambient noise furthermore is non-correlated between the right and left earphones 110 and 120. So the OED algorithm operated by the signal processor 135 may allow the use of correlation between right and left earphones 110 and 120, plus the correlation of the FB microphones 113 and 123 and the FF microphones 111 and 121, to identify local speech as VAD. Further, this process may provide a noise signal uncontaminated by local speech when run through a blind-source separation algorithm.

Local speech estimates may be further be refined using an input from the lapel unit 130 as a vertical endfire beamformer 132. An endfire beamformer 132 is any beamformer where the measured wave (e.g. speech) is directly incident to an array of measuring elements (e.g. the voice microphones 131), and hence a small degree phase difference (e.g. less than ten degrees) is measured between the measuring elements. The endfire beamformer 132 may be created by employing two or more voice microphones 131. The voice microphones 131 can then be weighted to virtually point the vertical endfire beamformer 132 vertically toward the users mouth, which is directly above the vertical endfire beamformer 132 when both earphones 110 and 120 are engaged. In other words, the voice microphones 131 may be positioned in the lapel unit 130 connected to the left earphone 120 and the right earphone 110. Hence, when the dual earphone engagement model 200 is applied, the voice microphones 131 may be employed as a vertical endfire beamformer 132 for isolating a noise signal from the voice signal when the left earphone 120 and the right earphone 110 are engaged.

It should be noted that many of the approaches discussed above do not work properly when a single earphone is not inserted into an ear, which may occur when a user takes a voice call while trying to maintain awareness of the local environment. As such, it is desirable to detect when the earphones 110 and 120 are not well-fitted in the ear according to OED. Hence, an OED mechanism can be used to improve binaural VAD, for example by removing false results when an earphone is not engaged, and by turning off the broadside beamformer 112 as discussed below.

Figure 3:
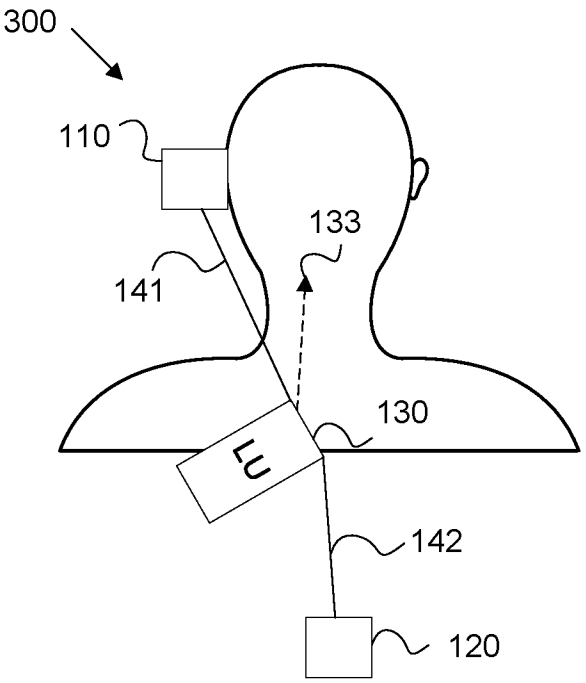
FIG. 3 is a schematic diagram of example right earphone engagement model for performing noise cancellation.

FIG. 3 is a schematic diagram of example right earphone engagement model 300 for performing noise cancellation. The right earphone engagement model 300 is employed when the OED process determines that the right earphone 110 is engaged and the left earphone 120 is disengaged. This scenario may result in a physical configuration, as shown, that includes the left earphone 120 hanging from the lapel unit 130 via the cable 142. As can be seen, the FF microphones 111 and 121 are no longer equidistant above the user's mouth. Hence any attempt to engaged the FF microphones 111 and 121 as a broadside beamformer 112 would result in erroneous data. For example, such usage may actually attenuate the voice signal and amplify noise. Hence, the broadside beamformer 112 is turned off in the right earphone engagement model 300.

Further, the left earphone 120 is no longer engaged, and hence comparing the FF microphone 121 and the FB microphone 123 may also result in faulty data as the microphones are no longer acoustically isolated. In other words, the signals of the FF microphone 121 and the FB microphone 123 are substantially similar in this configuration and no longer correctly distinguish between ambient noise and user voice. As such, the right earphone engagement model 300 is applied by employing a right earphone 110 FF microphone 111 and a right earphone 110 FB microphone 113 to isolate a noise signal from the voice signal without considering left earphone 120 microphones when the right earphone 110 is engaged and the left earphone 120 is not engaged.

In addition, the lapel unit 130 may be titled to the left of a straight vertical configuration when hanging from the engaged right earphone 110 via cable 141. As such, the beamformer may be adjusted to point toward the user's mouth in order to support accurate voice isolation. When adjusted in the fashion, the beamformer may be referred to as a right directional endfire beamformer 133, where right directional indicates a shift to the right of a vertical beamformer 132. The right directional endfire beamformer 133 may be created by adjusting voice microphone 131 weights to emphasis the voice signal recorded by the right most voice microphone 131. Hence, the right earphone engagement model 300 may be applied by employing the voice microphones 131 as a right directional endfire beamformer 133 for isolating a noise signal from the voice signal when the right earphone 110 is engaged and the left earphone 120 is not engaged.

Figure 4:
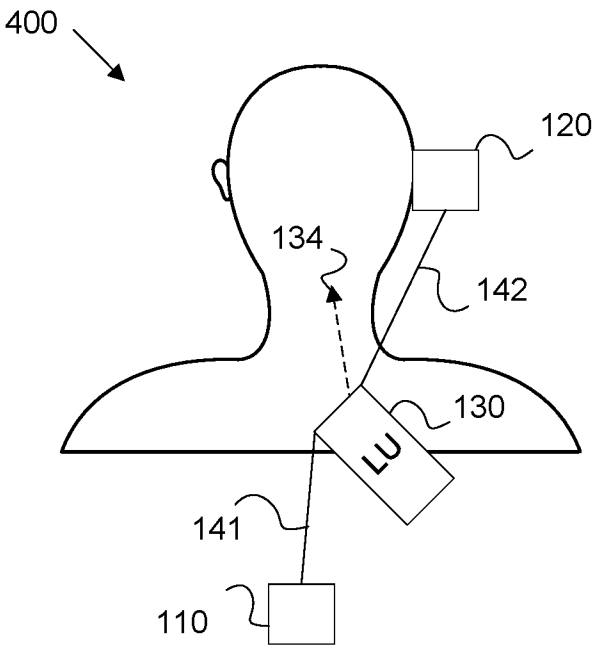
FIG. 4 is a schematic diagram of example left earphone engagement model for performing noise cancellation.

FIG. 4 is a schematic diagram of example left earphone engagement model 400 for performing noise cancellation. The left earphone engagement model 400 is employed when the OED process determines that the left earphone 120 is engaged and the right earphone 110 is disengaged. This results in the right earphone 110 hanging from the lapel unit 130 via cable 110 and the lapel unit 130 hanging from the left earphone 120 via cable 142. The left earphone engagement model 400 is substantially similar to the right earphone engagement model 300 with all directional processes reversed. In other words, the broadside beamformer 112 is turned off. Further, the left earphone engagement model 400 is applied by employing the left earphone 120 FF microphone 121 and the left earphone 120 FB microphone 123 to isolate a noise signal from the voice signal. However, the right earphone 110 microphones are not considered when the left earphone 120 is engaged and the right earphone 110 is not engaged.

In addition, the lapel unit 130 voice microphones 131 are pointed to the right of the vertical position in left earphone engagement model 400. As such, the beamformer may be adjusted to point toward the user's mouth in order to support accurate voice isolation. When adjusted in the fashion, the beamformer may be referred to as a left directional endfire beamformer 134, where left directional indicates a shift to the left of a vertical beamformer 132. The left directional endfire beamformer 134 may be created by adjusting voice microphone 131 weights to emphasis the voice signal recorded by the left most voice microphone 131. Therefore, the left earphone engagement model 400 is applied by employing the voice microphones 131 as a left directional endfire beamformer 134 for isolating a noise signal from the voice signal when the left earphone 120 is engaged and the right earphone 110 is not engaged.

Figure 5:
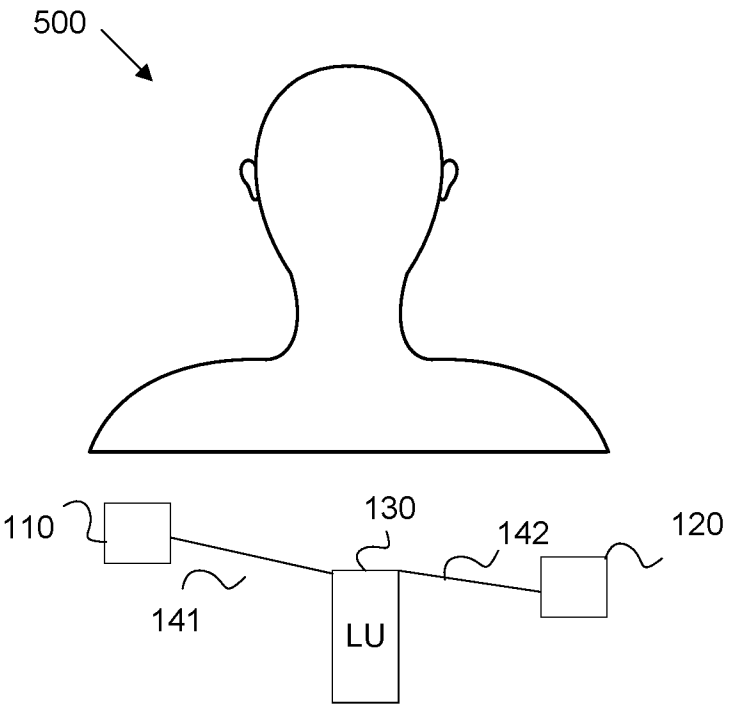
FIG. 5 is a schematic diagram of example null earphone engagement model for performing noise cancellation.

FIG. 5 is a schematic diagram of example null earphone engagement model 500 for performing noise cancellation. In the null engagement model 500, neither earphone 110 and 120 are properly engaged. In such a scenario, any attempts to perform ANC may potentially result in attenuating voice and/or amplifying noise. Accordingly, the null earphone engagement model 500 is applied by discontinuing beamformer usage to mitigate added noise when the left earphone 120 and the right earphone 110 are both disengaged. Further, correlation of the FB microphones 113 and 123 with the FF microphones 111 and 121, respectively, may also be discontinued to mitigate the possibility of attenuated voice and/or amplified noise.

In summary, the signal processor 135 can employ signal processing models 200, 300, 400, and/or 500, based on wearing position, to support mitigation of ambient noise in a recorded voice signal prior to uplink transmission during a phone call. These sub-systems may be implemented in separate modules in the signal processor, such as a VAD module and an OED module. These modules may operate in tandem to increase the accuracy of voice detection and noise mitigation. For example, VAD, derived from the earphone 110 and 120 microphones, may be used to improve transmit noise reduction as discussed above. This can be done in multiple ways. VAD may be employed as a guide for adaptation of beamforming in microphone pods/arrays. Adaptive beamformers may determine final beam direction by analyzing recorded sound for speech-like signals. It should be noted that the problem of speech detection from the microphones is non-trivial, and may be plagued by both false-negatives and false-positives. Improved VAD (e.g. recognizing when the headset 100 user is speaking) improves the adaptive beamformer performance by increased directional accuracy. Further, VAD may be employed as an input for a smart-mute process that drops the transmit signal to zero when the headset 100 user is not talking. VAD may also be employed as an input to continuous adaptation ANC systems. In a continuous adaption ANC system, the FB microphone signal may be treated as only the downlink signal and hence mostly devoid of noise. The FB microphone, when engaged, may also record a component of local talk from the user, which can be removed when the signal processor 135 is sure that the headset 100 user is speaking. Also, it is generally observed that FF adaptation is less accurate when the headset 100 user is speaking during adaption. Accordingly, VAD may be employed to freeze adaptation when the user is speaking.

The OED module may act as a mechanism for disregarding output of information derived from the earphones. OED detection can be performed by a variety of mechanism, such as comparing FF to FB signal levels, without affecting the utility of the information. When OED is determined for an earphone, correlation between earphone microphones is note used to obtain local speech estimates for either noise reduction or VAD (e.g. via beamforming, correlation of FF-Left and FF-Right signals, blind-source-separation, or other mechanisms). As such, OED becomes an input to VAD and any algorithm using FF and/or FB microphone signals. Also, as noted above, beamforming using the FF microphones is not effective if either earphone is disengaged.

Figure 6:
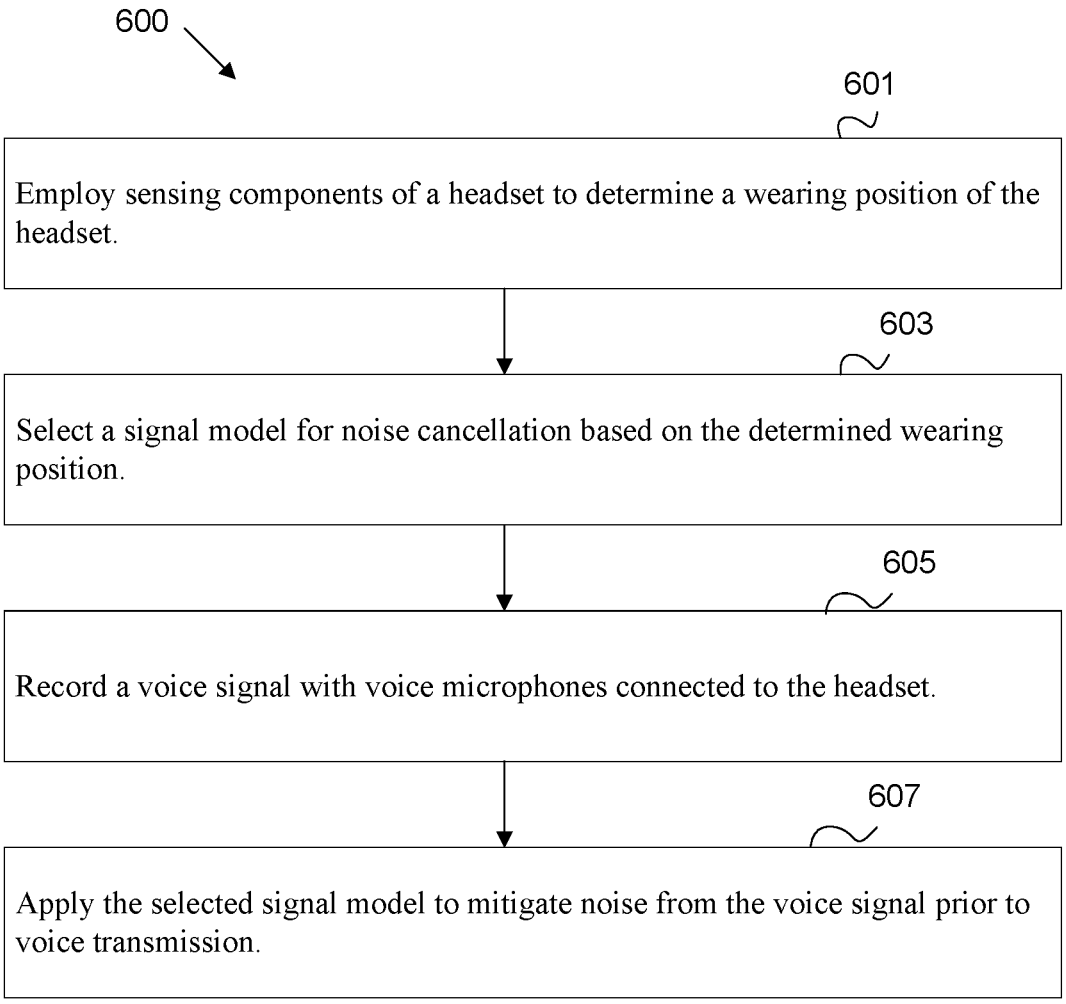
FIG. 6 is a flowchart of an example method for performing noise cancellation during uplink transmission.

FIG. 6 is a flowchart of an example method 600 for performing noise cancellation during uplink transmission, for example by employing a headset 100 processing signals according to models 200, 300, 400, and/or 500. In some examples, method 600 may be implemented as a computer program product, stored in memory and executed by a signal processor 135 and/or any other hardware, firmware, or other processing systems disclosed herein.

At block 601, sensing components, such as FB microphones 113 and 123, FF microphones 111 and 121, sensors 117 and 127, and/or voice microphones 131, of a headset 100 are employed to determine a wearing position of the headset. The wearing position may be determined by any mechanism disclosed herein, such as correlating recorded audio signals, considering optical and/or pressure sensors, etc. Once a wearing positioned is determined according to OED, a signal model is selected for noise cancellation at block 603. The signal model may be selected from a plurality of signal models based on the determined wearing position. As noted above, the plurality of models may include a left earphone engagement model 400, a right earphone engagement model 300, a dual earphone engagement model 200, and a null earphone engagement model 500.

At block 605, a voice signal is recorded at one or more voice microphones, such as voice microphones 131, connected to the headset. Further, at block 607, the selected model is applied to mitigate noise from the voice signal prior to voice transmission. It should be noted that block 607 may be applied after and/or in conjunction with block 605. As noted above, applying the dual earphone engagement model may include employing a left earphone FF microphone and a right earphone FF microphone as a broadside beamformer for isolating a noise signal from the voice signal when the left earphone and the right earphone are engaged. Further, applying the dual earphone engagement model may also include employing the voice microphones as a vertical endfire beamformer to isolate a noise signal from the voice signal when the left earphone and the right earphone are engaged. In some examples, applying the dual earphone engagement model may also include correlating a left earphone feed forward (FF) microphone signal and a right earphone FF microphone signal to isolate a noise signal from the voice signal when the left earphone and the right earphone are engaged. Also, applying the null earphone engagement model at block 607 includes discontinuing beamformer usage to mitigate added noise when the left earphone and the right earphone are both disengaged.

Further, applying the right earphone engagement model at block 607 includes employing a right earphone FF microphone and a right earphone FB microphone to isolate a noise signal from the voice signal without considering left earphone microphones when the right earphone is engaged and the left earphone is not engaged. Applying the right earphone engagement model at block 607 may also include employing the voice microphones as a right directional endfire beamformer for isolating a noise signal from the voice signal when the right earphone is engaged and the left earphone is not engaged.

In addition, applying the left earphone engagement model at bock 607 includes employing a left earphone FF microphone and a left earphone FB microphone to isolate a noise signal from the voice signal without considering right earphone microphones when the left earphone is engaged and the right earphone is not engaged. Finally, applying the left earphone engagement model at bock 607 may also include employing the voice microphones as a left directional endfire beamformer for isolating a noise signal from the voice signal when the left earphone is engaged and the right earphone is not engaged.

Examples of the disclosure may operate on a particularly created hardware, on firmware, digital signal processors, or on a specially programmed general purpose computer including a processor operating according to programmed instructions. The terms "controller" or "processor" as used herein are intended to include microprocessors, microcomputers, Application Specific Integrated Circuits (ASICs), and dedicated hardware controllers. One or more aspects of the disclosure may be embodied in computer-usable data and computer-executable instructions (e.g. computer program products), such as in one or more program modules, executed by one or more processors (including monitoring modules), or other devices. Generally, program modules include routines, programs, objects, components, data structures, etc. that perform particular tasks or implement particular abstract data types when executed by a processor in a computer or other device. The computer executable instructions may be stored on a non-transitory computer readable medium such as Random Access Memory (RAM), Read Only Memory (ROM), cache, Electrically Erasable Programmable Read-Only Memory (EEPROM), flash memory or other memory technology, and any other volatile or nonvolatile, removable or non-removable media implemented in any technology. Computer readable media excludes signals per se and transitory forms of signal transmission. In addition, the functionality may be embodied in whole or in part in firmware or hardware equivalents such as integrated circuits, field programmable gate arrays (FPGA), and the like. Particular data structures may be used to more effectively implement one or more aspects of the disclosure, and such data structures are contemplated within the scope of computer executable instructions and computer-usable data described herein.

Aspects of the present disclosure operate with various modifications and in alternative forms. Specific aspects have been shown by way of example in the drawings and are described in detail herein below. However, it should be noted that the examples disclosed herein are presented for the purposes of clarity of discussion and are not intended to limit the scope of the general concepts disclosed to the specific examples described herein unless expressly limited. As such, the present disclosure is intended to cover all modifications, equivalents, and alternatives of the described aspects in light of the attached drawings and claims.

References in the specification to embodiment, aspect, example, etc., indicate that the described item may include a particular feature, structure, or characteristic. However, every disclosed aspect may or may not necessarily include that particular feature, structure, or characteristic. Moreover, such phrases are not necessarily referring to the same aspect unless specifically noted. Further, when a particular feature, structure, or characteristic is described in connection with a particular aspect, such feature, structure, or characteristic can be employed in connection with another disclosed aspect whether or not such feature is explicitly described in conjunction with such other disclosed aspect.

EXAMPLES

Illustrative examples of the technologies disclosed herein are provided below. An embodiment of the technologies may include any one or more, and any combination of, the examples described below.

Example 1 includes a headset comprising: one or more earphones including one or more sensing components; one or more voice microphones to record a voice signal for voice transmission; and a signal processor coupled to the earphones and the voice microphones, the signal processor configured to: employ the sensing components to determine a wearing position of the headset, select a signal model for noise cancellation, the signal model selected from a plurality of signal models based on the determined wearing position, and apply the selected signal model to mitigate noise from the voice signal prior to voice transmission.

Example 2 includes the headset of Example 1, wherein the sensing components include a feedforward (FF) microphone and a feedback (FB) microphone, the wearing position of the headset determined based on a difference between a FF microphone signal and a FB microphone signal.

Example 3 includes the headset of any of Examples 1-2, wherein the sensing components include an optical sensor, a capacitive sensor, an infrared sensor, or combinations thereof.

Example 4 includes the headset of any of Examples 1-3, wherein the one or more earphones includes a left earphone and a right earphone, and the plurality of signal models include a left earphone engagement model, a right earphone engagement model, a dual earphone engagement model, and a null earphone engagement model.

Example 5 includes the headset of any of Examples 1-4, wherein the dual earphone engagement model is applied by employing a left earphone feed forward (FF) microphone and a right earphone FF microphone as a broadside beamformer for isolating a noise signal from the voice signal when the left earphone and the right earphone are engaged.

Example 6 includes the headset of any of Examples 1-5, wherein the voice microphones are positioned in a lapel unit connected to the left earphone and the right earphone, and the dual earphone engagement model is applied by employing the voice microphones as a vertical endfire beamformer for isolating a noise signal from the voice signal when the left earphone and the right earphone are engaged.

Example 7 includes the headset of any of Examples 1-6, wherein the dual earphone engagement model is applied by correlating a left earphone feed forward (FF) microphone signal and a right earphone FF microphone signal for isolating a noise signal from the voice signal when the left earphone and the right earphone are engaged.

Example 8 includes the headset of any of Examples 1-7, wherein the null earphone engagement model is applied by discontinuing beamformer usage to mitigate added noise when the left earphone and the right earphone are both disengaged.

Example 9 includes the headset of any of Examples 1-8, wherein the left earphone engagement model is applied by employing a left earphone feed forward (FF) microphone and a left earphone feedback (FB) microphone to isolate a noise signal from the voice signal without considering right earphone microphones when the left earphone is engaged and the right earphone is not engaged.

Example 10 includes the headset of any of Examples 1-9, wherein the voice microphones are positioned in a lapel unit connected to the left earphone and the right earphone, and the left earphone engagement model is applied by employing the voice microphones as a left directional endfire beamformer for isolating a noise signal from the voice signal when the left earphone is engaged and the right earphone is not engaged.

Example 11 includes the headset of any of Examples 1-10, wherein the right earphone engagement model is applied by employing a right earphone feed forward (FF) microphone and a right earphone feedback (FB) microphone to isolate a noise signal from the voice signal without considering left earphone microphones when the right earphone is engaged and the left earphone is not engaged.

Example 12 includes the headset of any of Examples 1-11, wherein the voice microphones are positioned in a lapel unit connected to the left earphone and the right earphone, and the right earphone engagement model is applied by employing the voice microphones as a right directional endfire beamformer for isolating a noise signal from the voice signal when the right earphone is engaged and the left earphone is not engaged.

Example 13 includes a method comprising: employing sensing components of a headset to determine a wearing position of the headset; selecting a signal model for noise cancellation, the signal model selected from a plurality of signal models based on the determined wearing position; recording a voice signal at one or more voice microphones connected to the headset; and applying the selected signal model to mitigate noise from the voice signal prior to voice transmission.

Example 14 includes the method of Example 13, wherein the headset includes a left earphone and a right earphone, and the plurality of signal models include a left earphone engagement model, a right earphone engagement model, a dual earphone engagement model, and a null earphone engagement model.

Example 15 includes the method of any of Examples 13-14, wherein applying the dual earphone engagement model includes employing a left earphone feed forward (FF) microphone and a right earphone FF microphone as a broadside beamformer for isolating a noise signal from the voice signal when the left earphone and the right earphone are engaged.

Example 16 includes the method of any of Examples 13-15, wherein the voice microphones are positioned in a lapel unit connected to the left earphone and the right earphone, and applying the dual earphone engagement model includes employing the voice microphones as a vertical endfire beamformer to isolate a noise signal from the voice signal when the left earphone and the right earphone are engaged.

Example 17 includes the method of any of Examples 13-16, wherein applying the dual earphone engagement model includes correlating a left earphone feed forward (FF) microphone signal and a right earphone FF microphone signal to isolate a noise signal from the voice signal when the left earphone and the right earphone are engaged.

Example 18 includes the method of any of Examples 13-17, wherein applying the null earphone engagement model includes discontinuing beamformer usage to mitigate added noise when the left earphone and the right earphone are both disengaged.

Example 19 includes the method of any of Examples 13-18, wherein applying the right earphone engagement model includes employing a right earphone feed forward (FF) microphone and a right earphone feedback (FB) microphone to isolate a noise signal from the voice signal without considering left earphone microphones when the right earphone is engaged and the left earphone is not engaged.

Example 20 includes the method of any of Examples 13-19, wherein the voice microphones are positioned in a lapel unit connected to the left earphone and the right earphone, and applying the left earphone engagement model includes employing the voice microphones as a left directional endfire beamformer for isolating a noise signal from the voice signal when the left earphone is engaged and the right earphone is not engaged.

Example 21 includes a computer program product that, when executed on a signal processor, causes a headset to perform a method according to any of Examples 13-20.

The previously described examples of the disclosed subject matter have many advantages that were either described or would be apparent to a person of ordinary skill. Even so, all of these advantages or features are not required in all versions of the disclosed apparatus, systems, or methods.

Additionally, this written description makes reference to particular features. It is to be understood that the disclosure in this specification includes all possible combinations of those particular features. Where a particular feature is disclosed in the context of a particular aspect or example, that feature can also be used, to the extent possible, in the context of other aspects and examples.

Also, when reference is made in this application to a method having two or more defined steps or operations, the defined steps or operations can be carried out in any order or simultaneously, unless the context excludes those possibilities.

Although specific examples of the disclosure have been illustrated and described for purposes of illustration, it will be understood that various modifications may be made without departing from the spirit and scope of the disclosure. Accordingly, the disclosure should not be limited except as by the appended claims.

I claim:

1. An active noise cancellation headset, comprising:

a first earphone including a first feedforward microphone and a first feedback microphone;

a second earphone including a second feedforward microphone and a second feedback microphone;

one or more voice microphones to record a voice signal for voice transmission; and a signal processor configured to determine a wearing position of the first earphone and the second earphone, to select a signal model from a plurality of signal models and a beamformer configuration of the first feedforward microphone, the first feedback microphone, the second feedforward microphone, and the second feedback microphone based on the determined wearing position to isolate a noise signal from the voice signal.

2. The active noise cancellation headset of claim 1 wherein the signal processor is configured to determine the wearing position of the first earphone and the second earphone based on a difference between a feedforward microphone signal of one of the first feedforward microphone and the second feedforward microphone and a feedback microphone signal from one of the first feedback microphone and the second feedback microphone.

3. The active noise cancellation headset of claim 1 wherein the first earphone further includes a first sensing component and the second earphone includes a second sensing component.

4. The headset of claim 3 wherein the first sensing component and the second sensing component each includes at least one of an optical sensor, a capacitive sensor, or an infrared sensor, or combinations thereof.

5. The headset of claim 1 wherein the plurality of signal models includes a dual earphone engagement model, a single earphone engagement model, and a null earphone engagement model.

6. The headset of claim 5 wherein the beamformer configuration includes a broadside beamformer configuration, a vertical endfire beamformer configuration, or a discontinued beamformer configuration.

7. The headset of claim 6 wherein the broadside beamformer configuration is selected when the dual earphone engagement model is selected, the vertical endfire beamformer configuration is selected when the single earphone engagement model is selected, and the discontinued beamformer configuration is selected when the null earphone engagement model is selected.

8. The headset of claim 6 wherein the broadside beamformer configuration includes employing the first feedforward microphone and the second feedforward microphone as the broadside beamformer.

9. The headset of claim 6 wherein the vertical endfire beamformer configuration includes employing the one or more voice microphones as the directional endfire beamformer, and employing the first feedforward microphone and the first feedback microphone without considering the second feedforward microphone and the second feedback microphone for isolating the noise signal from the voice signal.

10. The headset of claim 5 wherein the dual earphone engagement model is applied by correlating a signal from the first feedforward microphone and a signal from the second feedforward microphone for isolating the noise signal from the voice signal when the first earphone and the second earphone are engaged.

11. The headset of claim 1 wherein the voice microphones are positioned in a lapel unit connected to the first earphone and the second earphone, and the lapel unit is included in the beamformer configuration.

12. A method for isolating a noise signal from a voice signal in a headset, comprising:

determining a wearing position of the headset, the wearing position including a single earphone engagement, a dual earphone engagement, and a null earphone engagement;

selecting a signal model for noise cancellation, the signal model selected from a plurality of signal models based on the determined wearing position;

receiving a voice signal from one or more voice microphones; and selecting a beamformer configuration of a first feedforward microphone of a first earphone, a first feedback microphone of the first earphone, a second feedforward microphone of a second earphone, and a second feedback microphone of the second earphone based on the determined wearing position to isolate a noise signal from the voice signal.

13. The method of claim 12 wherein determining the wearing position of the headset is based on a difference between a feedforward microphone signal of one of the first feedforward microphone and the second feedforward microphone and a feedback microphone signal from one of the first feedback microphone and the second feedback microphone.

14. The method of claim 12 wherein determining the wearing position of the headset is based on an output from one or more sensing components, the sensing components including at least one of an optical sensor, a capacitive sensor, or an infrared sensor.

15. The method of claim 12 wherein the beamformer configuration includes a broadside beamformer configuration, a vertical endfire beamformer configuration, or a discontinued beamformer configuration.

16. The method of claim 15 wherein the broadside beamformer configuration is selected when the wearing position is a dual earphone engagement, the vertical endfire beamformer configuration is selected when the wearing position is a single earphone engagement, and the discontinued beamformer configuration is selected when the wearing position is neither the first earphone or the second earphone are engaged.

17. The method of claim 15 wherein the vertical endfire beamformer configuration includes employing the one or more voice microphones as the directional endfire beamformer, and employing the first feedforward microphone and the first feedback microphone without considering the second feedforward microphone and the second feedback microphone for isolating the noise signal from the voice signal.

18. The method of claim 15 wherein the broadside beamformer configuration includes employing the first feedforward microphone and the second feedforward microphone as the broadside beamformer.

19. The method of claim 18 wherein employing the first feedforward microphone and the second feedforward microphone as the broadside beamformer includes correlating a signal from the first feedforward microphone and a signal from the second_feedforward microphone for isolating the noise signal from the voice signal when the first earphone and the second earphone are engaged.

20. The method of claim 12 wherein the voice microphones are positioned in a lapel unit connected to the first earphone and the second earphone, and the lapel unit is included in the beamformer configuration.

* * * * *